United States Patent [19]

Barozzi et al.

[11] 4,332,488

[45] Jun. 1, 1982

[54] DEVICE FOR THE CONTROL OF THE POSITION OF THE TYPE CARRYING ELEMENT IN TYPEWRITERS

[75] Inventors: Gian P. Barozzi; Giancarlo Horeschi, both of Tokyo, Japan

[73] Assignee: Xelavis S.A., Panama City, Panama

[21] Appl. No.: 168,386

[22] Filed: Jul. 10, 1980

[30] Foreign Application Priority Data

Jul. 11, 1979 [IT] Italy ..... 24281 A/79

[51] Int. Cl.[3] ..... B41J 1/60

[52] U.S. Cl. ..... 400/161.5; 400/168.1

[58] Field of Search ..... 400/161.5, 162.1, 161.1

[56] References Cited

U.S. PATENT DOCUMENTS 2,879,876 3/1959 Palmer et al. ..... 400/162.1 X 3,666,070 5/1972 Schaefer ..... 400/161.5

*Primary Examiner*—Paul T. Sewell

*Attorney, Agent, or Firm*—Karl F. Ross

[57] ABSTRACT

A device for controlling the positioning of a single element type-carrier for typewriters or the like comprises a plurality of kinematic chains, each comprising a transverse rod connected with sliding elements fitted with cam windows suitable to control, by means of corresponding cams, the pulleys carrying the control wire of the type-carrying element, each kinematic chain being actuated directly by an interposer associated with a related key lever.

6 Claims, 5 Drawing Figures

DEVICE FOR THE CONTROL OF THE POSITION OF THE TYPE CARRYING ELEMENT IN TYPEWRITERS

FIELD OF THE INVENTION

The present invention relates to a device for the control of the positioning of the type-carrying element in typewriters or a like printing machine, in which the type-carrying element can be for instance, a sphere (ball), cylinder or like element.

BACKGROUND OF THE INVENTION

As is known, in typewriters with a single type-carrying element, the setting of the selected type face obtained by pressing the relevant key on the keyboard, is transmitted to the type-carrying element through a series of elements which: first preset the movement to be carried out; thereafter other means intervene for rotation in both directions of the type-carrying element.

Such devices, for presetting and actuation complicate very much these typewriters, raise their production costs and are a source of continuous malfunctioning, consequent to the complication of the systems utilized and of the difficulty of their maintenance.

OBJECT OF THE INVENTION

It is the object of this invention to eliminate such disadvantages and simplify notably the machine by enabling the positioning of the type-carrying element directly by means of levers and tie rods whose action follows directly the operation of the selected key without the presetting movement and related mechanism.

SUMMARY OF THE INVENTION

This object is attained in a typewriter of electric type fitted with a single type-carrying element, by providing a plurality of kinematic chains each comprising a transverse rod connected with sliding parts having cam windows, which act with their cams on pulleys carrying the wire which controls the type-carrying element, each kinematic chain being actuated directly by an interposer in contact with its own key lever, while each of the interposers has fingers to effect the movements in accordance with a given code for setting the required type face, each of the kinematic chains acting separately or in combination with the others depending on the movements required by the character chosen at the keyboard.

It is further possible to arrange that the operation of the interposer associated to the key lever is effected by an actuating bail positively operating in both directions by cams, which meets the end of the interposer which has been lowered by setting the character of the relevant key, and such interposer is displaced axially by the actuating bail and actuates in its turn by means of its own fingers, the transverse rods connected to such side sliding parts.

It is further possible to arrange that the sliding parts for the control of the type-carrying element are provided each with a cam window, inclined with respect to the axis of the motion of the sliding part itself, such cam causing the transverse displacement of the mentioned pulley carrying the control wire of the typ-carrying element in of an amount corresponding to the rotation of such element necessary to bring into position the chosen face.

The control mechanism for the rotation both around the horizontal axis and around the vertical axis of the type-carrying element is fitted with elastic means applied to the pulleys for the movement of the wire, against the elastic means for the traction of the same wire, in a way that equilibrates the two actions and reduces notably the forces necessary for the movement of such pulleys.

In order to switch from the lower-case letters to the upper-case letters, a pair of levers are provided on the axis of the idler pulley of said wire, to displace this axis to turn the type-carrying element through a half turn, such levers being subjected to the action of two support springs for the equilibrium of the whole unit.

We provide in association with each transverse rod a toothed rod, allowing the sliding of a stop solidly mounted on to the actuating bail, to permit the travel of the required path of the transverse rods and related sliding parts and to withhold such transverse rods in the case of accidental continuation of the motion beyond the required point.

According to one aspect of the present invention, there is provided a device for the control of the positioning of the type-carrying single element for typewriters or similar machines, characterized by comprising a plurality of kinematic chains each comprising a transverse rod connected with sliding elements fitted with cam windows or slots suitable to control, by means of cams, the pulleys carrying the control wire of the type-carrying element, each kinematic chain being actuated directly by an interposer associated with a related key lever. Each interposer has a plurality of projections placed according to a certain code of selection of the chosen characters, and suited to effectuate the required movements. Such projections are missing, in the case of null positioning, or being present in the number of one or two, one of which is provided to actuate the movements of said type carrying element around a horizontal axis and one of the other, in alternative, being provided to actuate the movements of said type-carrying element around the vertical axis on either side of the zero positions each of said kinematic chains acting separately according to the movements required by the character selected at the keyboard.

BRIEF DESCRIPTION OF THE DRAWING

These and other characteristics will be evident from the detailed description of a device for the control of the positioning of the type-carrying element in typewriters or like machines, shown as an example in the attached drawing in which.

SPECIFIC DESCRIPTION

Figure 1:
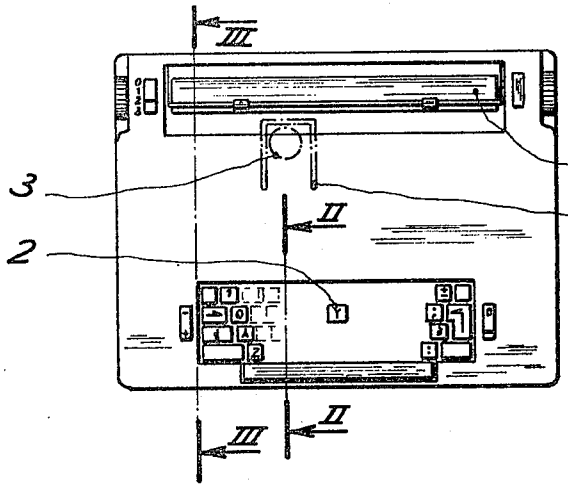
FIG. 1 is a top view of the typewriter as a whole.

FIG. 1 is a schematic plan of an electric typewriter having a platen 1, the keyboard 2, a type-carrying element of the sphere type, generally indicated by 3, and a carriage carrying the sphere element 3, indicated by 4, which in the case shown is of the movable type since during the typing the sphere 3 with its carriage 4 is displaced from one end to the other transversally, while it is turned and tilted to bring the type face chosen by the key at the keyboard, to the printing point in front of platen 1 in order to be able to type the character on the paper.

In the same carriage 4 is also mounted a cartridge housing the writing ribbon, of any type, which moves together with the carriage in all the writing positions.

The invention concerns, as already said, the device which, starting from the key at the keyboard, executes the necessary movements of the sphere element to take to the printing point the character corresponding to the pressed key.

Each key 2*a* of the keyboard 2 actuates a key lever 2*b* which is pivoted on a transverse axis 5 which supports all the keys levers.

The key lever 2*b* has a projection 2*c* which is in contact with a leaf spring 6 held at one end by a transverse frame 7 and resting on a projection 8 of the frame in order to constitute a fixed fulcrum, allowing therefore the spring 6 to move as a balance on point 8 formed at the free end by the frame 7.

The projection 2*c* of the lever 2*b* presses with a downwardly turned end 6*a* of the same spring 6, against an interposer or slide 9 which can move substantially in a horizontal direction on a guide built into the frame 7 and, on the other side, on a frame 10 which is fixed to the machine main structure and offers two guides 10*a*–10*b* within which the parts 9*a*–9*b* of the interposer 9 slide.

The upper part 9*b* of the interposer 9 has a hook to which a spring 11 is applied, anchored at the opposite end to the corresponding hook of the frame 10.

This spring 11 tends to displace the interposer constantly in the direction of arrow A (FIG. 2) and at the same time draws it upwardly.

The interposer in the section 9*a* has a tooth 9*c*, which engages with a part of the fixed frame 10, thus preventing the interposer motion in the direction of arrow A.

At the same time the part 9*a* of the same interposer rests on the frame 10, under the action of the spring 11.

The end 6*a* of the spring 6, facing the interposer 9 moves it downwardly when the key lever 2*b* is pressed.

The lowering of the sliding element 9 causes the disengagement of the tooth 9*c* of the same from the stop of the frame 10 so that the interposer 9 is free to move, under the action of the spring 11, in the direction of arrow A for a distance that is sufficient to allow the end 9*a* of the interposer 9 to hit against a bar 12 which on its turn starts the cycle, switching on the electric motor or the means connected to it, in order to drive the main shaft 13.

On the main shaft three cams 14–15–16 are mounted which have separate tasks according to the movements to be imparted to the interposer 9.

The cams 14 and 15 are a cam and countercam pair for the movement of the interposer in the horizontal direction, opposite to that of arrow A; cam 16 provides the disengagement of other elements from the interposer 9 as will be explained below.

A swing lever 18 hinged on a fixed shaft 19 carries a roller 17 which is in contact with said cam 14, while on the same swing lever 18 a small connecting rod 20 is pivoted, which with its other end is connected to a crank 22 by means of the pivot 21.

This crank 22 is pivoted on a fixed shaft 23 and, on the other end, it is connected to a shaft 24 rigidly connected to a bail 25, which is supported at its extremity by the plate 25*a* on which a protruding pin 25*b* is applied inserted in a groove 26 of a vertical sliding element 27.

This vertical sliding element 27 in the upper part is guided by the same fixed shaft 5 on which all the levers of the keys 2*b* are pivoted and in its lower section by a pin fixed to the frame on which it can slide by means of an elongated slot.

On cam 15, which acts as a countercam for cam 14, the end 18*a* of the swing lever 18 rests in a manner suitable to operate positively the swing lever in both directions by means of the mentioned two cams excluding therefore the need for return springs or similar devices.

The cam 16 rigidly connected to the driving shaft 13 offers a rest profile 16*a* and a work profile 16*b*, and is in contact with the end 29*a* of a swing lever 29 pivotally mounted on the fixed shaft 23 and having the other end 29*b* engaged with the same sliding element 27 in such a manner as to be able to oscillate with it.

The swing lever is constantly subjected to the action of the spring which keeps the end 29*a* in contact with the cam 16.

Figure 2:
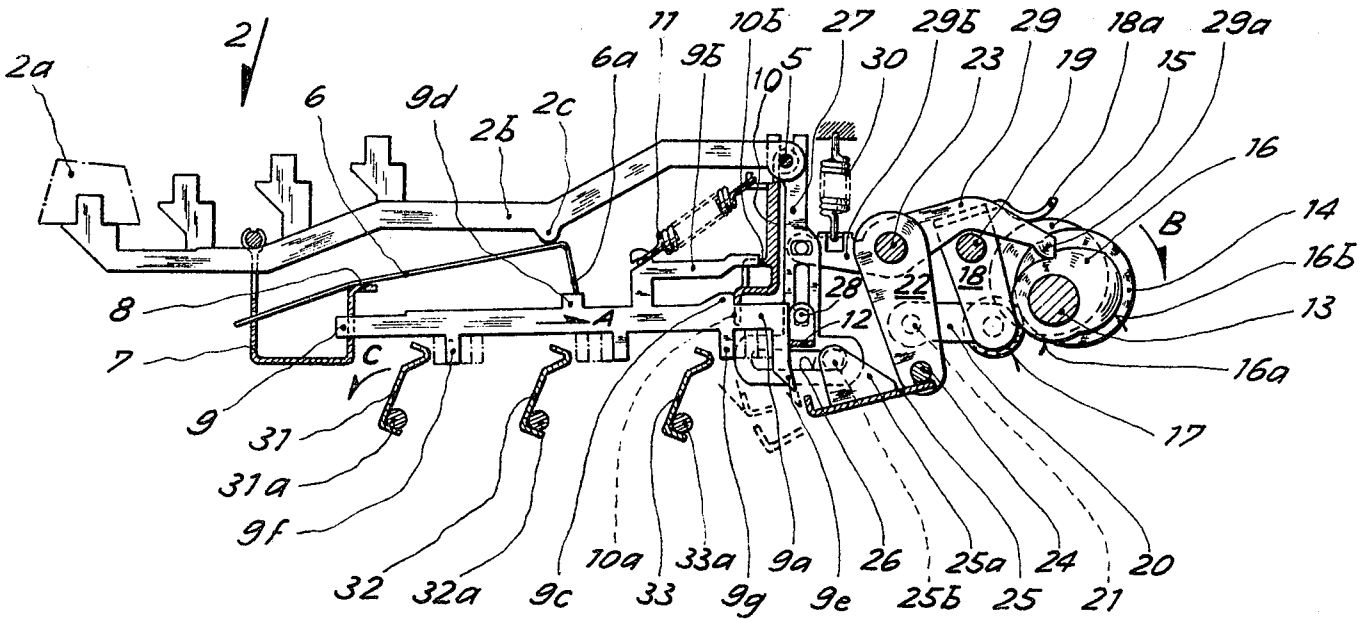
FIG. 2 is a sectional view along II—II of FIG. 1.

The same interposer 9 presents in its lower part other projections among which the first, starting from the right side according to the drawing of FIG. 2, is the one below the extremity 9*a* indicated by 9*e*, which is tooth shaped.

Furthermore on the lower edge of the same interposer 9 there may be up to two projections 9*f* and 9*g* which can be placed in any manner in relation to other parts which shall be mentioned in the following, and in relation to the type face corresponding to the key lever placed above the interposer 9.

The said projections 9*f*–9*g* are placed according to a given code, in order to be able to effectuate the positioning of the type-carrying sphere and therefore they can be placed in any of the two positions shown, or also in the intermediate one, not numbered.

In correspondence to the projections 9*f*–9*g* there are transverse rods 31–32–33 rigidly connected to small shafts 31*a*–32*a*–33*a* which run across the whole span of the machine and are pivoted with their ends on the sides of the machine.

The said rods 31–32–33 may therefore oscillate in the direction shown by arrow C when the projections 9*f*–9*g* come in contact with the free end of the transverse rods 31–32–33 as will be explained in the following.

The projections 9*f*–9*g* provided under each interposer 9, may also be missing or up to two of them may be present in different positions and with different distances, according to the code relative to the letter represented by the interposer to which they belong.

Such projections, if they are just two in number, may come in contact with two of the mentioned rods, which may be either the rods 33 and 31 or the rods 33 and 32 but never the rods 31 and 32 together.

The projections of the interposer 9 may also control just one of the three rods 31–32–33 or, if they are missing, none of them, and this corresponds to the null position of the type-carrying sphere when it is in the rest position.

The operation of the elements which have been described referring to FIG. 1 and to FIG. 2 is the following: lowering the key 2*a*, the end 6*a* of the spring 6 is also lowered causing, through the action of the projection 9*d*, the lowering of the interposer 9.

The lowering of interposer 9 allows the tooth 9*c* to pass under the ledge of the respective slot of the frame 10, and at that point, the spring 11, pulls the interposer 9 in the direction of the arrow A, moving the bar 12, starting thereby the operation cycle of the electric motor.

Together with the lowering of the tooth 9*c*, the interposer extremity 9*e* is also lowered, coming into the position shown by the dashed line, in front of the free end of the bail 25 when it is in rest position.

At this point the electric motor has been switched on and therefore the shaft 13 rotates in the direction of arrow B driving also the cams rigidly connected to it.

The cam 14 displaces the roller 17 towards the left and as consequence of this movement, the small rod 20 with the pivot 21 rotates the crank 22 to which is pivotally coupled the mentioned bail 25 to the left.

With this movement the bail 25 hits against the end 9*e* of the interposer 9 which was lowered pulling to the left the same element, to the position indicated by the dashed line.

As has been said the said of the projection 9*e* of the interposer 9 facing the bail 25 is inclined in the opposite direction and because of this, the interposer 9 remains in contact with the same bail 25 during the movement and also when the interposer stops in the position most displaced to the left.

This effect is obtained since the spring 11 subjects the interposer 9 to displacement along arrow A, maintains a tight friction contact between the projection 9*e* and the end of the bail 25.

With the displacement of the interposer in the direction opposite to that of arrow A the projections placed under it come in contact with one or two transverse rods 31–32–33.

In the case shown in FIG. 2 it is meant that the projections under the interposer 9 are those indicated by the numbers 9*f*–9*g* so that the transverse rods coming in contact with them are the rods number 31 and 33.

Both these rods are therefore subjected to rotation in the direction of arrow C, together with their shafts, for an amount equal to the total displacement of the projections diminished by the distance existing in the rest position between each projection and the end of the transverse rod with which the same projection comes in contact.

The travel of the transverse rod is therefore related to the code according to which the projections 9*f*–9*g* are placed.

While the interposer 9 is displaced in the direction opposite so that of arrow A, at the same time the cam 16 has rotated of a certain angle, coming out of the rest path 16*a*, and entering the outer work path 16*b*.

At this point the end 29*a* of the swing lever 29 is raised and the same swing lever with the other end lowers the vertical sliding element 27 which, with its slot 26 and the pin 25*b* inserted in it, lowers the transverse bail 25 from the forward position in contact with the projection 9*e* to the lower position indicated by the dashed line.

The lowering of the end of the bail 25 releases the tooth 9*e* of the interposer 9 from the contact.

The interposer 9 under the action of the spring 11 is submitted to displacement in the direction of arrow A and upwards, coming again in the position shown in FIG. 2. by a full line.

Then the countercam 15 provides the displacement of the projection 18*a* of the swing lever 18 so that movement of bail 25 is reversed coming in the position to the right, while at the same time the cam 16 with its profile 16*b* allows the swing lever 29 to come back pulled by the spring 30 in the initial rest position.

Together with the swing lever 29 also the other end of the slider 27 comes in such position which, on its turn, raises the bail 25 bringing it back into the position shown in FIG. 2 in solid lines.

Such oscillation movement of the bail 25 in the forward direction, downwards, backwards and again upwards is provided, by the present invention, in order to prevent the bail from hitting the projection which is placed under the interposer 9, during the return movement to the rest position, if such interposer 9 has been previously set for the typing of character to be positioned later.

Figure 3:
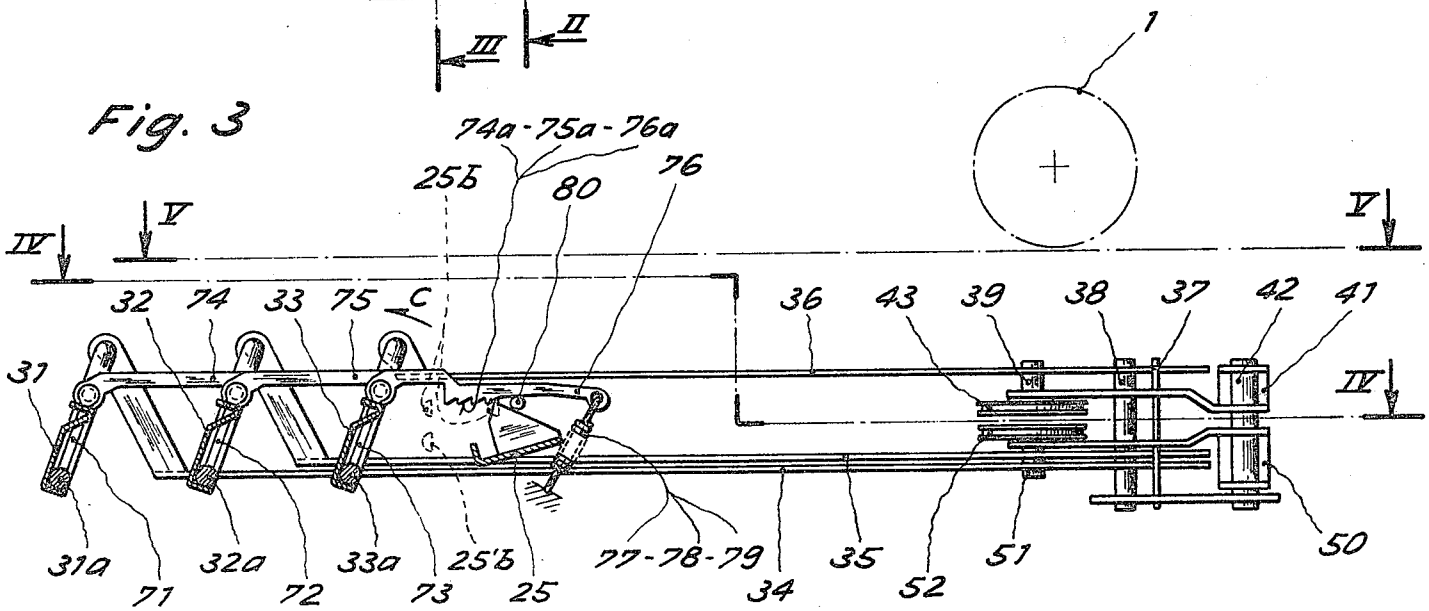
FIG. 3 is a sectional view along III—III of FIG. 1.
Figure 4:
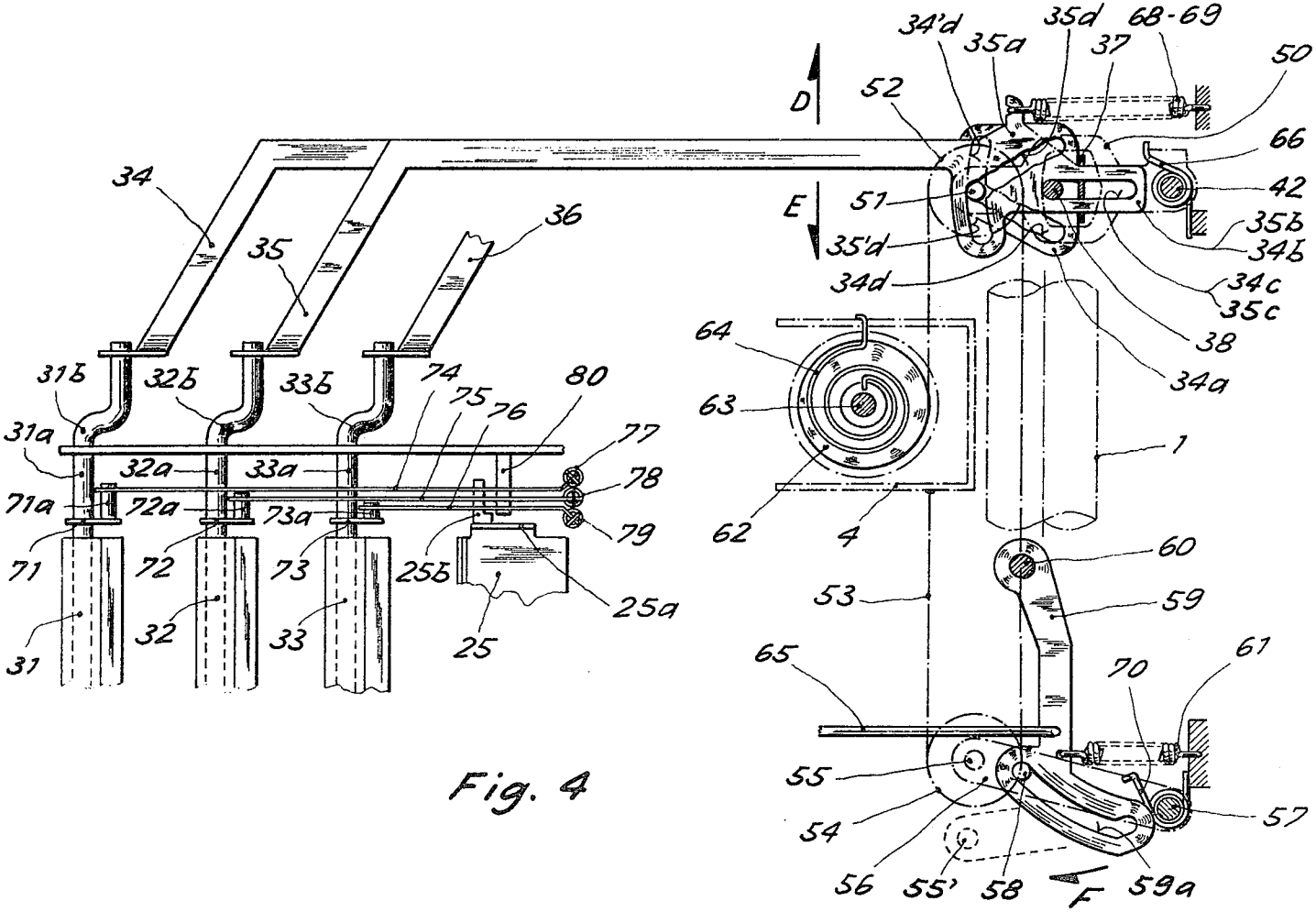
FIG. 4 is a sectional view along line IV—IV of FIG. 3.
Figure 5:
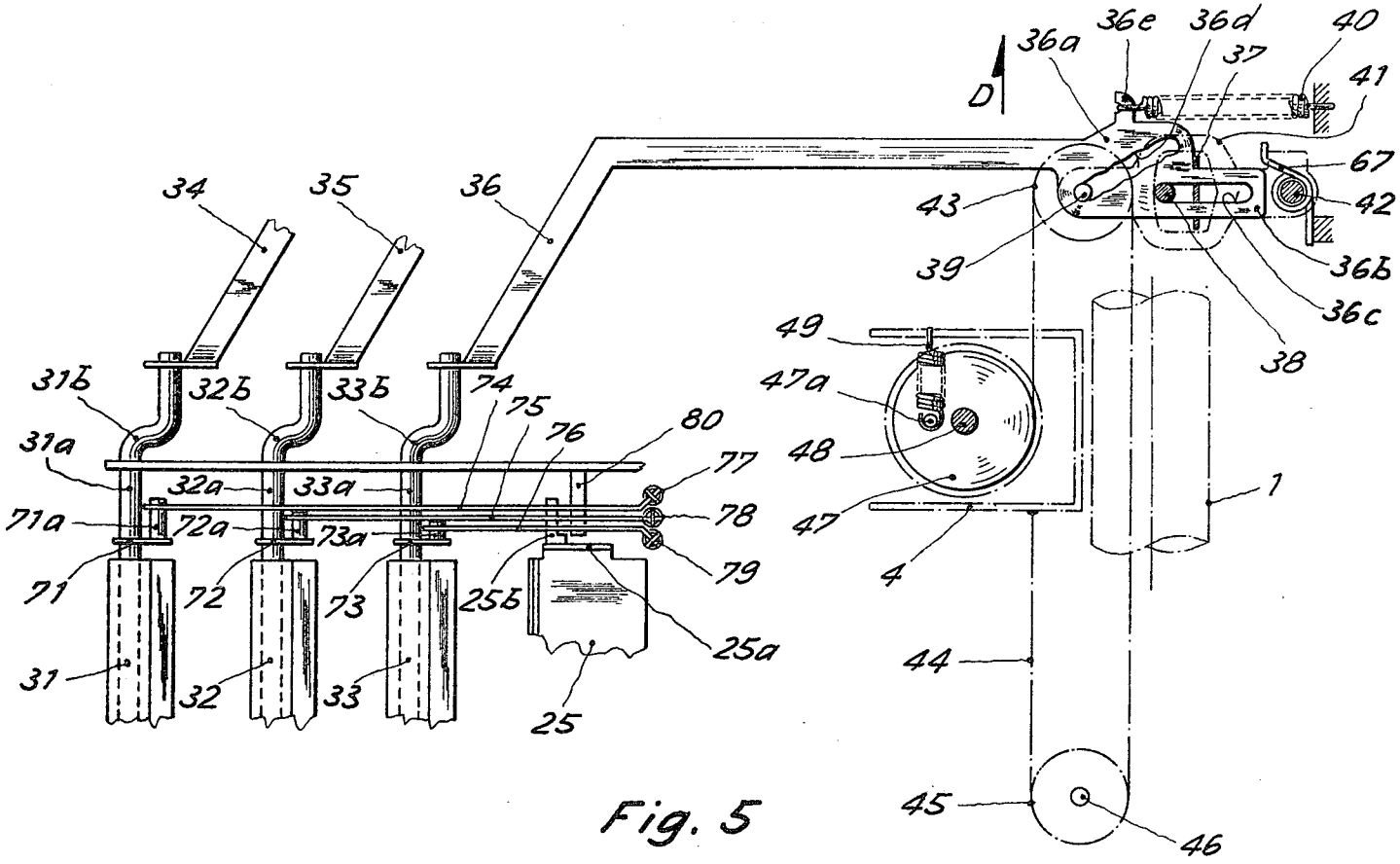
FIG. 5 is a sectional view along line V—V of FIG. 3.

FIGS. 3, 4, 5 show the successive operations occuring starting from the oscillatory movements of the shafts 31*a*–32*a* or 33*a* actuated, as already said, by the movement of the key and of the other means described so far.

In FIG. 3, which shows a vertical section outside the keyboard, as indicated by III—III in FIG. 1, the three shafts 31*a*–32*a*–33*a* are shown, together with their corresponding rods 31–32–33 in rest position; each one of said shafts has an extremity bent upwards as cranks 31*b*–32*b*–33*b* (see FIG. 4) on which are pivoted parallel sliding elements 34–35–36 which are shown sideways in FIG. 3 and from above in FIG. 4.

These sliding elements, at the end opposite to that of the connection with the cranks of the shafts 31*a*–32*a*–33*a*, are fitted with a cam, which will be explained referring to FIG. 5, in which only the slider 36 is shown.

Such sliding element 36, at the end opposite to the one which is hinged on such crankshaft, has an end shape comprising two parts 36*a* and 36*b*; the latter rests against a vertical plate 37 and has an elongated slot in which a fixed pin 38 is inserted, which allows a longitudinal displacement guided by such slot, to the sliding element 36.

The part 36*a* has a slot 36*d* inclined with respect to the axis of the slot 36*c*, that is with respect to the direction of displacement of the sliding element 36 and is shaped with a particular profile which acts essentially as a cam allowing a pin 39 to take definite positions along the same slot.

Such inclination compels the pin 39 to take different positions in the transverse direction following the longitudinal displacement of the slot 36*d*.

In order to allow the pin 39 taking some preset positions without necessity of high precision in the construction, the slot 36*d*, although inclined, offers some preferred stopping position in which the pin is caught within a small segment parallel to the axis of the slot 36*c* so that even a limited longitudinal movement of the slider 36 does not perturb the transverse position of the pin.

The sliding element 36 is always pulled in the rest position, to the right by a spring 40 parallel to the slot 36*c*, and anchored to the fixed frame of the machine and hooked to the same sliding element by means of the projection 36*e*.

The pin 39 is rigidly connected to a rod 41 hinged on the fixed shaft 42 and oscillating by virtue of the pin 39 when the same is in a different position in the slot 36*d* of the sliding element 36.

On the pin 39 a pulley 43 is pivoted, rigidly connected to the connecting rod 41, and connected by means of a stretched wire 44 to a pulley 45 freely rotating on the shaft 46 fixed to the frame.

Said wire 44 follows a loop starting from the carriage 4, it goes over the pulley 45, reaches pulley 43 and winds on a wheel 47 rotating on the shaft 48.

Said shaft 48 cooperates with other known means to the positioning of the sphere, as shall be explained in the following.

The wheel 47 is constantly subjected by the spring 49 to rotation in the clockwise direction.

The spring 49 is hooked with one end at the carriage 4 and with the other to the pivot 47*a* fixed to the wheel 47.

Referring to FIG. 4, the same sliding elements are shown again, but the sliding element 34 and 35 are fully illustrated, with their end parts, opposite to the ones engage with the crankshafts, having cam and sliding profiles similar to those already described for the sliding element 36.

The sliding element 35 terminates with an enlarged surface 35*a* and with a part 35*b* similar to the corresponding parts of the sliding element 36 and indeed the part 35*b* has a slot 35*c* sliding on the fixed pin 38, for the same purposes mentioned relatively to the sliding element 36 (longitudinal guide), while the enlarged part 35*a* of the sliding element has a cam shaped slot 35*d* inclined and equal to the corresponding inclined slot of the cam 36*d* already mentioned.

In addition and following the slot 35*d*, there is another segment of slot 35*d* arc shaped whose center is one the fixed shaft 42 and whose span is given by an angle corresponding to the width of the inclined cam 35*d* in the radial direction.

The sliding element 34 has a similar enlarged shape at its free end, with a part 34*b* fitted with a slot 34*c* respectively superimposed, in FIG. 4, to the 35*b* and 35*c*, both sliding on the fixed pin 38, and an enlarged part 34*a* in which the cam slots 34*d* and 34*d* are cut, exactly opposite to those of the sliding element 35 previously described.

The slot 34*d* is indeed in a position tilted and symmetrical with respect to that of the slot 35*d* relatively to the direction of motion given by the slot 34*c*.

The part of curved slot 34'*d* is a sector of circle with center on the shaft 42, but opposite to the sector of circle 35'*d* of the sliding element 35.

Hinged on the shaft 42 there is furthermore a lever 50 carrying a pin 51 aligned with the pin 39 already mentioned relatively to the sliding element 36.

Such pin 51 goes through the slots 35*d*–35'*d* and 34*d*–34'*d* of the relative sliding elements 34 and 35.

The position of the cam shaped slots 35*d*–35'*d* and 34*d*–34'*d* equal and opposite allows furthermore to lock in the rest position the pin 51 in the exact point corresponding to the null position of the type-carrying element, without need for supplementary means for the positioning of the pin 51.

Indeed the vertex of the angle between the part with the inclined cam and that with the sector of circle of each slot rests on the pin 51 on opposite sides in the direction of the movement of the pin 51, so that, until one of the two slots is displaced, the pin 51 cannot move from the central position, corresponding, as said, to the null position.

On the same pin 51 another pulley 52 is pivoted on which a wire 53 is wound stretched at the opposite end on a pulley 54 rotating freely on the pivot 55 supported by the lever 56 hinged on a fixed shaft 57 and having a pin 58 sliding within a slot 59*a* of a lever 59 hinged on a fixed shaft 60 and submitted to anticlockwise rotation by the spring 61.

Said lever 56 can take two positions, as consequence of the movement of lever 59, (one is shown with dash-dot line) so that the pin is shifted from the position 55 to the position 55' shown in FIG. 4.

The wire 53 starts from a fixed point on the carriage 4, winds around pulley 54 then around pulley 52 and with the free end it winds around the wheel 62 pivoted on a shaft 63 of the carriage 4 and coaxial with the shaft 48 pivoting on the same carriage 4 already mentioned.

The lever 59 hinged in 60 is submitted to displacement in the direction opposite to that of the spring 61, by a tie rod 65 operated by the keys of the typewriter when one to shift from the small letters to the capitals, as explained further on.

Referring to the FIGS. 4 and 5 on the same fixed shaft 42 some spiral springs 66–67 are wound which with one extremity resting on the fixed frame, submit respectively the levers 50 and 41 to clockwise rotation.

Since such levers 41 and 50 are rigidly connected to the pins 39 and 51 on which the pulleys 43 and 52 stretching the wire 44 and 53 are pivoted, said springs, tend to rotate the pins 39 and 51 in the clockwise direction stretching the corresponding wires and this tension is in contrast with the tension of the wires caused by the springs 49 and 64 applied to the wheels 47 and 62 and fixed to the carriage 4.

These springs 66–67 are placed, according to the invention, in order to balance the effect of said springs 49 and 64 so that the displacement of said pins 39 and 51 fixed to the corresponding levers 41 and 50 should not overcome too a large resistance.

As matter of fact, the stretching of the wires 53 and 44 is pratically balanced by the opposite actions of the aforementioned springs.

Consequently, by virtue of such arrangement, the pins 39 and 51 may slide within the cam slots of the corresponding sliding elements without encountering excessive friction due to pressure among the pins and the slots.

The operation of the part so far described referring to the FIGS. 3–4 and 5 is the following: when one of the shafts 31*a*–32*a*–33*a* is turning by effect of the displacement of the interposer 9 as already explained, and assuming for simplicity that such shaft is the shaft 33*a* which is connected to the sliding element 36 (see FIG. 5), the oscillation movement of the shaft 33*a* causes a displacement to the left of the sliding element 36 of an amount corresponding to the angular displacement of the same shaft 33*a*, in relation to the movement of the interposer 9 with its projection 9*g*.

The displacement of the left of said sliding element 36 causes the displacement of the cam 36*d* which, being tilted, will compel the pin 39 to displace toward the outside following the arrow D, and this has the effect of pulling the wire 44 causing the rotation of the wheel 47 of an amount proportional to the position of the character which has caused the displacement of the interposer 9 and therefore that of the sliding element 36.

The turning of the wheel 47 causes the rotation of the shaft 48 rigidly connected to it, and connected by known means to the type-carrying element 3, making it oscillate around a horizontal axis.

This allows to bring, in known fashion, the various rows of characters, which are distributed along the parallels of the type-carrying element (assuming that it is spherical) in the printing position for the chosen character.

In the case shown in FIG. 2, the projection 9*f* faces the rod 31 and therefore, when it comes in contact with it, turns the shaft 31*a* which is connected to the sliding element 34 which is under the slider 35 in FIG. 4.

In this case, said sliding element 34 is fitted with the cam slot 34*d* ending in the arc shaped slot 34'*d;* therefore for a displacement to the left of the sliding element 34, the pin 51 is forced to follow the cam 34*d* and to go toward the inside along arrow E.

The pin 51 comes close to the opposite pin 55 shortening the length of the wire 53 and allowing therefore the winding of the same wire around the wheel 62 under the action of the spring 64.

Such rotation of the wheel 62 rotates of an equal amount the shaft 63 controlling the rotation of the type carrying element 3 around a vertical axis for an amount corresponding to the displacement of the same shaft and therefore corresponding to the letter selected by the relative key.

Such movement allows the setting of the character following the meridian of the sphere in which it is found.

During the displacement of the cam 34*d,* as already said, the pin 51 must be free to displace following said arrow E and this is allowed by the segment of cam 35'*d,* arc shaped, of the sliding element 35 which being as said, arc shaped with center in 42, does not present obstacles to the movement of the relative lever 50 which supports the pin.

In the same way the segment of arc shaped cam 34'*d* of the sliding element 34 would allow the displacement of the pin 51 if, by effect of the cam 35*d* should be displaced following the arrow D for an axial movement of the relative sliding element and of one of the projections placed under the interposer 9, which, this time, would be in contact with the rod 32 rotating the same rod and the associated shaft 32*a.*

After the displacements the sliding elements 34 and 35 are brought back to the rest position by the relative springs 68–69 placed parallel to the slots 34*c* and 35*c.*

Therefore, as has been said, referring to the means described in FIG. 5 one has a movement of the type-carrying element, assumed spherical in the instant case, following the parallel planes on which the type are found, while referring to FIG. 4 one has a movement following the meridian planes, that is with a rotation of the sphere around a vertical axis to place it according to the meridian position of the selected type.

If the two movements, around the horizontal axis, and around the vertical axis are controlled simultaneously by the interposer which has been displaced and through the two projections placed under it, the two movements are combined, so that the sphere will simultaneously turn around the horizontal axis and the vertical axis, placing the character to be typed at the printing point.

The device described referring to FIG. 4 and located in the position opposite to that of pulley 52, has the function of allowing the use of the capital letters, while the small letters are always found in printing position.

Said positioning is obtained with the means already described referring to FIG. 4 and pulling the tie rod 65 connected with the key of the capitals.

This action on the rod 65 displaces the lever 59 around the pin 60 to the left following arrow F so that the pin 58 rigidly connected to the lever 56 is displaced downwards until the lever 56 takes the position indicated by the dashed line in which the pin 55 takes the position 55'.

With such movement the pin 55 is placed away from the pin 51 so that the wire 53 is further stretched turning the wheel 62 of an angle of 180°, which has the effect of overturning the position of the sphere relative to the platen.

In such position the letters ready on the printing side are the capitals and the movements for the search of the selected letter occur as already described referring to the small letters.

Around the shaft 57 a spring 70 is placed, which displaces the lever 56 always toward the outside in order to balance the traction exerted by spring 64 on the wheel 62, and balancing in this way the two forces so that the pin 58 remains substantially in equilibrium and does not press on the slot 59*a* during the displacement to pass from the small letters to the capitals.

In the present invention some safety means are also provided, in order to avoid that accidental movements or sudden displacements or inertia forces may subject to stress the rods 31–32–33 and therefore turn the shafts 31*a*–32*a*–33*a* in an unwanted way, with consequences on the wrong displacement of the type-carrying element.

To such end (see FIGS. 3, 4, 5) some levers 71–72–73 are provided, rigidly connected to the shafts 31*a*–32*a*–33*a,* such levers being coupled via the pins 71*a*–72*a*–73*a* to the toothed rods 74–75–76.

Such rods are fitted on their lower side with teeth 74*a*–75*a*–76*a* and with the end opposite to the pivoted one, they are kept in contact with stop pin 80, by the springs 77–78–79.

Referring to FIGS. 3 and 5 only the operation of the rod 76 will be described, with its set of teeth 76*a,* since the other rods work in identical manner.

Each set of teeth of each rod is in contact with the pin 25*b* of the bail 25 fixed to the plate 25*a.*

Said pin 25*b* has a vertical plane faced in front of the straight part of the teeth 76*a,* so that, when the bail 25 is displaced forward by the aforementioned means, driven by the cam 14 connected to the shaft 13 or the motor, the shaft 33*a* is submitted to rotation following arrow C and also the rod 76 is subjected to displacement to the left, resting on the support pin 80.

With such movement both the part 25 and 76 are displaced to the left with the same speed and for an equal amount.

At the end of the displacement caused by bail 25, the rod 76 must stop.

However, since the shaft 31*a*–32*a* or 33*a* is free to rotate under the action of the projections of the interposer 9, same shaft can continue its rotation by inertia if the circumstances allow it.

This would permit 76 to go on its travel with the consequence that also the sliding element 36 associated to it, would be displaced too much, with a consequent wrong displacement of the type—carrying sphere.

Such event is prevented because when the bail 25 is displaced to the position indicated by the dashed line in FIG. 2, also the relative pin 25*b* takes the position shown by the dashed line in FIG. 3 and the rod 76 which is engaged with one of the teeth 76*a,* is forced to stop too, because the tooth rests with its straight edge on the plane face of said pin 25*b.*

In this way the rod cannot, for any reason, slide any further in the forward direction.

The rod 76 is however released when the bail 25 by effect of the movement of the cam 16, is lowered, as shown in FIG. 2, and the pin 25*b* goes in the lowered position 25'*b*, releasing in such way the teeth 76*a* from the relative stop.

As it appears from FIG. 3 the teeth 76*a* of the rod 76 are four since four displacements are to be provided for the movements to imparted to the type carrying element.

The bail 25 can be displaced for all the path defined by cam 14 without having to pull the corresponding lever 76 since such lever will jump on the pin 25*b* for the segment of path preceding the point of contact between the projection located under the interposer 9 and relative rod.

From now on, the rods 76 and bail 25 move together.

All the means of the kinematic chain which have been used for the movement of the sphere following the operation of the relative key, are brought back into the rest position at the end of the cycle, by their corresponding return springs which have been already described referring to each part of such kinematic chain.

A further means of zero resetting of all the elements simultaneously, of a known kind, may be also provided, but it has not been described or shown in the present description.

It is clear that many variants of embodiment can be provided in order to make the device described in the present invention suitable to fit a particular kind of typewriters, as well as it is possible to apply same device to type writers with the type-carrying element, in which the control device is fixed while the platen is movable, without departing from the spirit and the essential characteristics of the invention.

We claim:

1. In a printing machine having a platen, a single-element type carrier juxtaposed with said platen and provided with typefaces for applying corresponding characters to a paper lying against said platen, a keyboard provided with keys associated with said characters and actuatable to selectively position respective typefaces at a printing location, and a mechanism for operatively coupling said keys with said element for positioning same, the improvement wherein said mechanism comprises:

a respective slidable interposer actuatable by each key and formed with a coded contour representing the selected key;

cam means on said machine operable upon actuation of each key for displacing the respective interposer;

a plurality of rods each provided with formations selectively engageable with the coded contours of said interposers for selective angular displacement to selective angular extents in accordance with the selected typefaces;

respective bars eccentrically connected to said rods and shiftable by said rods with displacements determined by the angular displacements of said rods by said coded contours, each of said bars having a slot inclined to its direction of displacement;

a respective shaft received in each slot and carrying a respective pulley, each of said shafts being guided for displacement in a direction disaligned from that of the respective slot whereby displacement of each bar causes the respective slot to cam the respective shaft directly into a position determined by the contour of an interposer of an actuated key; and a respective wire operatively connected with said element and passing around each pulley whereby movement of each pulley deflects said element in a respective sense so as to dispose the typeface associated with each actuated key at said location.

2. The improvement defined in claim 1 wherein said cam means includes: a power shaft provided with a plurality of cams including a pair of cams operatively coupled with an angularly disposable bail engageable with said interposers for displacing same, and a further cam connected with said bail for disengaging said bail from said interposers.

3. The improvement defined in claim 1 wherein said slots are formed with indexing profiles for registering said shaft at predetermined locations of said slots.

4. The improvement defined in claim 1, further comprising balancing spring means acting upon each wire, thereby reducing the forces applied thereto for movement of said wires.

5. The improvement defined in claim 1, further comprising a pair of levers operatively connected with said element and effective to angularly displace the same through a half turn for shifting from lower case to upper case characters, said levers cooperating with oppositely effective springs providing a balance therebetween.

6. The improvement defined in claim 2 wherein toothed members are provided to permit sliding of a stop rigidly mounted on said bail so as to permit idle movement of said bail and impede continuation of the motion of the bars when the bail action is completed.

* * * * *